US012420983B1

(12) United States Patent
Schell

(10) Patent No.: US 12,420,983 B1
(45) Date of Patent: Sep. 23, 2025

(54) ADJUSTABLE BASKET APPARATUS FOR A COOLER

(71) Applicant: Tyler Schell, Denver, CO (US)

(72) Inventor: Tyler Schell, Denver, CO (US)

( * ) Notice: Subject to any disclaimer, the term of this patent is extended or adjusted under 35 U.S.C. 154(b) by 0 days.

(21) Appl. No.: 19/034,536

(22) Filed: Jan. 22, 2025

(51) Int. Cl.

| | |
|---|---|
| ***B65D 21/02*** | (2006.01) |
| ***B65D 6/08*** | (2006.01) |
| ***B65D 21/08*** | (2006.01) |
| ***B65D 25/28*** | (2006.01) |
| ***F25D 23/12*** | (2006.01) |

(52) U.S. Cl.
CPC ..... *B65D 21/086* (2013.01); *B65D 7/20* (2013.01); *B65D 25/282* (2013.01); *F25D 23/12* (2013.01)

(58) Field of Classification Search
CPC .. B65D 21/086; B65D 21/0233; B65D 21/02; B65D 25/16; F25D 23/12
USPC ..... 220/23.88, 23.87, 23.86
See application file for complete search history.

(56) References Cited

U.S. PATENT DOCUMENTS

| | | | | |
|---|---|---|---|---|
| 2,635,779 | A * | 4/1953 | Pfeiffer | F25D 25/022 220/756 |
| 3,052,508 | A * | 9/1962 | Fink | F25D 13/02 312/351 |
| 8,875,934 | B2 * | 11/2014 | Deka | B65D 81/3823 220/23.88 |
| 10,099,816 | B2 * | 10/2018 | Summers | F25D 3/08 |
| 10,669,067 | B1 * | 6/2020 | Paterson | A45C 11/008 |
| 2011/0006022 | A1 * | 1/2011 | Caveney | H02G 3/0443 248/250 |
| 2015/0208860 | A1 * | 7/2015 | Parr | A47J 36/10 220/573.1 |
| 2021/0171237 | A1 * | 6/2021 | Hsu | B65D 21/086 |

* cited by examiner

*Primary Examiner* — Stephen J Castellano
(74) *Attorney, Agent, or Firm* — Intellectual Strategies

(57) ABSTRACT

A basket apparatus includes a base comprising of a supporting infrastructure holding and retaining items within the basket apparatus and a rim coupled to the base, wherein the rim forms a perimeter opening to the base of the basket apparatus. The base is adjustable in length in at least one direction and wherein the rim is adjustable in length in the at least one direction. The basket further includes a retention apparatus configured to lock the rim in place in the at least one direction. The basket further includes a first edge engagement piece and a second edge engagement piece located on opposite ends of the perimeter opening. The edge engagement pieces are orthogonal to the at least one direction. The edge engagement pieces are configured to engage opposite walls of a cooler and suspend a bottom of the base above a floor of the cooler.

20 Claims, 9 Drawing Sheets

ADJUSTABLE BASKET APPARATUS FOR A COOLER

BACKGROUND

When ice melts in a cooler, it turns into water that can accumulate at the bottom. This pooled water can seep into food packaging, causing it to become soggy or contaminated. Loose or poorly sealed items are especially vulnerable, as they can be submerged or splashed, leading to spoilage or an unappealing texture. Maintaining dry storage within the cooler is essential to prevent food from coming into direct contact with melting ice and to preserve its freshness and quality.

Embodiments of the invention are designed to keep food dry inside coolers and protected from melting ice resting on the bottom of the cooler. This disclosure relates generally to a basket apparatus. More specifically, this disclosure relates to an adjustable cooler basket apparatus that allows for use in various size coolers. Embodiments of the basket apparatus are versatile and can be used in coolers resting on internal ledges or it can be used in coolers without internal ledges. Its body can be manufactured from a variety of materials, such as wire mesh, similar to a colander, plastic, or other sturdy options, ensuring durability and adaptability for different cooler designs.

SUMMARY

The subject matter of the present application has been developed in response to the present state of the art, and in particular, in response to the problems and disadvantages associated with conventional deposition that have not yet been fully solved by currently available techniques. Accordingly, the subject matter of the present application has been developed to provide embodiments of an apparatus that overcomes at least some of the shortcomings of prior art techniques.

Disclosed herein is a basket apparatus. The basket apparatus includes a base comprising of a supporting infrastructure holding and retaining items within the basket apparatus and a rim coupled to the base, wherein the rim forms a perimeter opening to the base of the basket apparatus. The base is adjustable in length in at least one direction and wherein the rim is adjustable in length in the at least one direction. The basket further includes a retention apparatus configured to lock the rim in place in the at least one direction. The basket further includes a first edge engagement piece and a second edge engagement piece located on opposite ends of the perimeter opening. The edge engagement pieces are orthogonal to the at least one direction. The edge engagement pieces are configured to engage opposite walls of a cooler and suspend a bottom of the base above a floor of the cooler. The preceding subject matter of this paragraph characterizes example 1 of the present disclosure.

The first and second edge engagement pieces include rubber pads, wherein the rubber pads are configured to be in a stable position on the walls of the cooler or freezer via friction. The preceding subject matter of this paragraph characterizes example 2 of the present disclosure, wherein example 2 also includes the subject matter according to example 1, above.

The first and second edge engagement pieces are extended out from the rim. The preceding subject matter of this paragraph characterizes example 3 of the present disclosure, wherein example 3 also includes the subject matter according to any one of examples 1-2, above.

The first and second edge engagement pieces form a handle on the opposite ends of the perimeter opening and wherein the rubber pads form part of the handle. The preceding subject matter of this paragraph characterizes example 4 of the present disclosure, wherein example 4 also includes the subject matter according to any one of examples 1-3, above.

The base and rim includes a first basket frame and a second basket frame, wherein the first basket frame is an inner frame and the second basket frame is an outer frame, wherein the first and second basket frames are configured to overlap with the outer frame around the inner frame, whereby the base and rim are adjustable in length. The preceding subject matter of this paragraph characterizes example 5 of the present disclosure, wherein example 5 also includes the subject matter according to any one of examples 1-4, above.

The basket apparatus is adjustable in length and the basket apparatus includes a fully extended configuration and a fully contracted configuration. The preceding subject matter of this paragraph characterizes example 6 of the present disclosure, wherein example 6 also includes the subject matter according to any one of examples 1-5, above.

The fully extended configuration is longer than the fully contracted configuration. The preceding subject matter of this paragraph characterizes example 7 of the present disclosure, wherein example 7 also includes the subject matter according to any one of examples 1-6, above.

The rim further includes a rim track including a recessed track running along a portion of the rim. The preceding subject matter of this paragraph characterizes example 8 of the present disclosure, wherein example 8 also includes the subject matter according to any one of examples 1-7, above.

The retention apparatus is configured to engage the first basket frame with the second basket frame and lock the length of the basket apparatus. The preceding subject matter of this paragraph characterizes example 9 of the present disclosure, wherein example 9 also includes the subject matter according to any one of examples 1-8, above.

The base includes a plurality of tines forming a lattice. The preceding subject matter of this paragraph characterizes example 10 of the present disclosure, wherein example 10 also includes the subject matter according to any one of examples 1-9, above.

Disclosed herein is an adjustable cooler basket apparatus. The cooler basket apparatus includes a base comprising of a supporting infrastructure holding and retaining items within the cooler basket apparatus and a rim coupled to the base, wherein the rim forms a perimeter opening to the base of the cooler basket apparatus. The base is adjustable in length in at least one direction and wherein the rim is adjustable in length in the at least one direction. The basket further includes a first edge engagement piece and a second edge engagement piece located on opposite ends of the perimeter opening. The edge engagement pieces are orthogonal to the at least one direction. The edge engagement pieces are configured to engage opposite walls of a cooler and suspend a bottom of the base above a floor of the cooler. The preceding subject matter of this paragraph characterizes example 11 of the present disclosure.

The first and second edge engagement pieces include rubber pads, wherein the rubber pads are configured to be in a stable position on the walls of the cooler or freezer via friction. The preceding subject matter of this paragraph characterizes example 12 of the present disclosure, wherein example 12 also includes the subject matter according to example 11, above.

The first and second edge engagement pieces are extended out from the rim. The preceding subject matter of this paragraph characterizes example 13 of the present disclosure.

The first and second edge engagement pieces form a handle on the opposite ends of the perimeter opening and wherein the rubber pads form part of the handle. The preceding subject matter of this paragraph characterizes example 14 of the present disclosure, wherein example 14 also includes the subject matter according to any one of examples 11-13, above.

The apparatus includes a retention apparatus configured to lock the rim in place in the at least one direction. The preceding subject matter of this paragraph characterizes example 15 of the present disclosure, wherein example 15 also includes the subject matter according to any one of examples 11-14, above.

The base and rim includes a first basket frame and a second basket frame, wherein the first basket frame is an inner frame and the second basket frame is an outer frame, wherein the first and second basket frames are configured to overlap with the outer frame around the inner frame, whereby the base and rim are adjustable in length. The preceding subject matter of this paragraph characterizes example 16 of the present disclosure, wherein example 16 also includes the subject matter according to any one of examples 11-15, above.

The basket apparatus is adjustable in length and the basket apparatus includes a fully extended configuration and a fully contracted configuration. The preceding subject matter of this paragraph characterizes example 17 of the present disclosure, wherein example 17 also includes the subject matter according to any one of examples 11-16, above.

The fully extended configuration is longer than the fully contracted configuration. The preceding subject matter of this paragraph characterizes example 18 of the present disclosure, wherein example 18 also includes the subject matter according to any one of examples 11-17, above.

The rim further includes a rim track including a recessed track running along a portion of the rim. The preceding subject matter of this paragraph characterizes example 19 of the present disclosure, wherein example 19 also includes the subject matter according to any one of examples 11-18, above.

The retention apparatus is configured to engage the first basket frame with the second basket frame and lock the length of the basket apparatus. The preceding subject matter of this paragraph characterizes example 20 of the present disclosure, wherein example 20 also includes the subject matter according to any one of examples 11-19, above.

Other aspects and advantages of embodiments of the present invention will become apparent from the following detailed description, taken in conjunction with the accompanying drawings, illustrated by way of example of the principles of the invention.

BRIEF DESCRIPTION OF THE DRAWINGS

In order that the advantages of the subject matter may be more readily understood, a more particular description of the subject matter briefly described above will be rendered by reference to specific embodiments that are illustrated in the appended drawings. Understanding that these drawings depict only typical embodiments of the subject matter and are not therefore to be considered limiting of its scope, the subject matter will be described and explained with additional specificity and detail through the use of the drawings.

Throughout the description, similar reference numbers may be used to identify similar elements. The following list is an example of the reference numbers used in the accompanying drawings.

Figure 1:
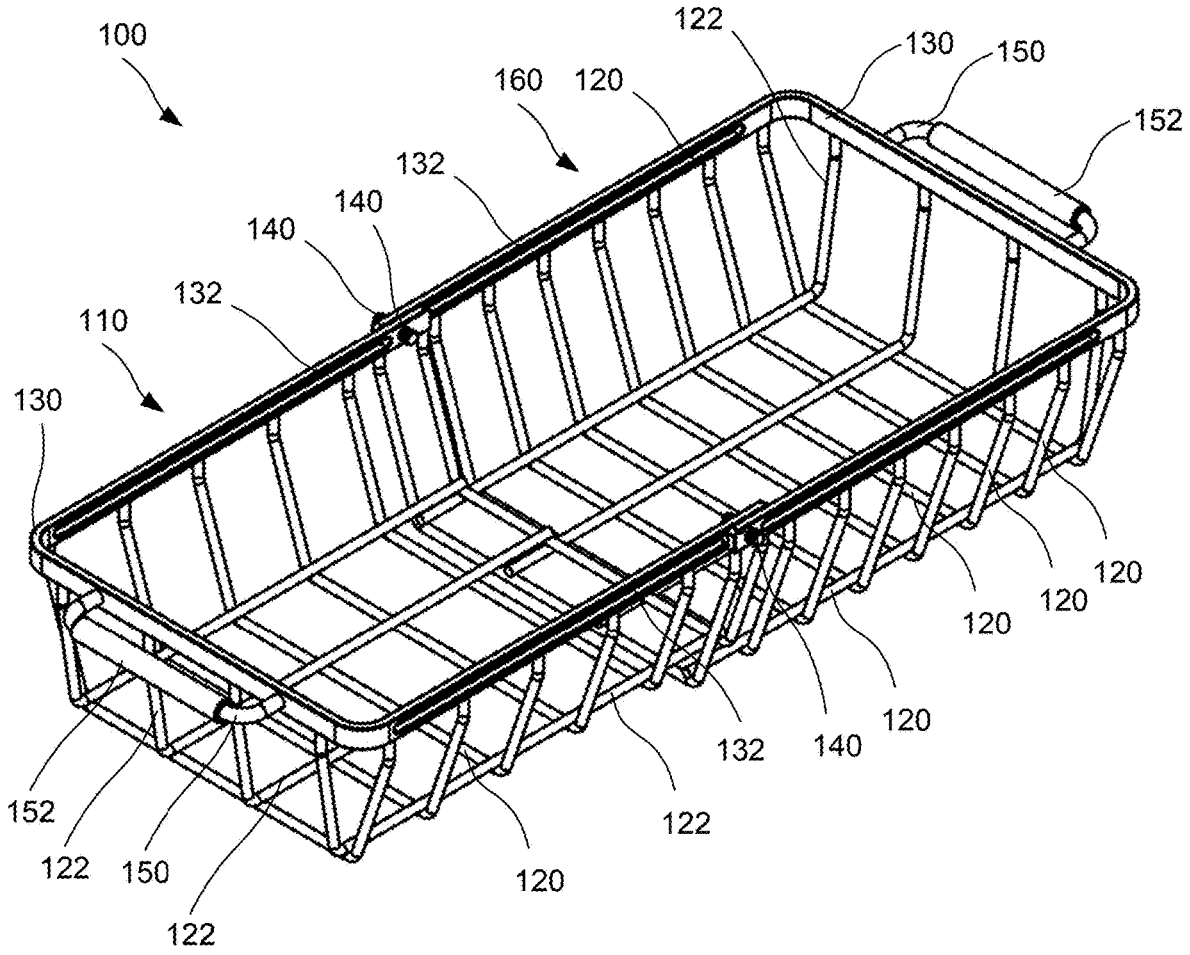
FIG. 1 depicts a perspective view of an adjustable cooler basket apparatus in a fully extended configuration, according to one or more embodiments of this disclosure.

| Reference # | Designation |
|---|---|
| 100 | Adjustable cooler basket |
| 110 | Inner basket frame |
| 120 | Lateral tine |
| 122 | Longitudinal tine |
| 130 | Basket rim frame |
| 132 | Rim Track |
| 140 | Retention Device |
| 150 | Handle frame |
| 152 | Handle |
| 160 | Outer Basket frame |
| 200 | Cooler |
| 210 | Cooler Sidewall |
| 222 | Cooler Ledge |

Throughout this application, similar designations or vocabulary may be used to identify similar elements, although the breadth of this disclosure should be understood to incorporate any alternatives and variations referenced within the specification (including the claims) and the accompanying drawings.

DETAILED DESCRIPTION

It will be readily understood that the components of the embodiments as generally described herein and illustrated in the appended figures could be arranged and designed in a wide variety of different configurations. Thus, the following more detailed description of various embodiments, as represented in the figures, is not intended to limit the scope of the present disclosure but is merely representative of various embodiments. While the various aspects of the embodiments are presented in drawings, the drawings are not necessarily drawn to scale unless specifically indicated.

The present invention may be embodied in other specific forms without departing from its spirit or essential characteristics. The embodiments described are to be considered in all respects only as illustrative and not restrictive. The scope of the invention is, therefore, indicated by the appended claims rather than by this detailed description. All changes which come within the meaning and range of equivalency of the claims are to be embraced within their scope.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussions of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize, in light of the description herein, that the invention can be practiced without one or more of the specific features or advantages of a particular embodiment. In other instances, additional features and advantages may be recognized in certain embodiments that may not be present in all embodiments of the invention.

Reference throughout this specification to "one embodiment," "an embodiment," or similar language means that a particular feature, structure, or characteristic described in connection with the indicated embodiment is included in at least one embodiment of the present invention. Thus, the phrases "in one embodiment," "in an embodiment," and similar language throughout this specification may, but do not necessarily, all refer to the same embodiment.

Furthermore, the described features, advantages, and characteristics of the invention may be combined in any suitable manner in one or more embodiments. One skilled in the relevant art will recognize, in light of the description herein, that the invention can be practiced without one or more of the specific features or advantages of a particular embodiment. In other instances, additional features and advantages may be recognized in certain embodiments that may not be present in all embodiments of the invention.

Reference throughout this specification to "one embodiment," "an embodiment," or similar language means that a particular feature, structure, or characteristic described in connection with the indicated embodiment is included in at least one embodiment of the present invention. Thus, the phrases "in one embodiment," "in an embodiment," and similar language throughout this specification may, but do not necessarily, all refer to the same embodiment.

When ice melts in a cooler, it turns into water that can accumulate at the bottom. This pooled water can seep into food packaging, causing it to become soggy or contaminated. Loose or poorly sealed items are especially vulnerable, as they can be submerged or splashed, leading to spoilage or an unappealing texture. Maintaining dry storage within the cooler is essential to prevent food from coming into direct contact with melting ice and to preserve its freshness and quality.

Embodiments of the invention are designed to keep food dry inside coolers and protected from melting ice resting on the bottom of the cooler. This disclosure relates generally to a basket apparatus. More specifically, this disclosure relates to a cooler basket apparatus that allows for use in various size coolers. Embodiments of the basket apparatus are versatile and can be used in coolers resting on internal ledges or it can be used in coolers without internal ledges. Its body can be manufactured from a variety of materials, such as wire mesh, similar to a colander, plastic, or other sturdy options, ensuring durability and adaptability for different cooler designs.

Disclosed herein is an adjustable cooler basket apparatus. In some embodiments, the cooler basket apparatus includes a base comprising of a supporting infrastructure holding and retaining items within the cooler basket apparatus and a rim coupled to the base, wherein the rim forms a perimeter opening to the base of the cooler basket apparatus. In some embodiments, the base is adjustable in length in at least one direction and wherein the rim is adjustable in length in the at least one direction. In some embodiments, the basket includes a first edge engagement piece and a second edge engagement piece located on opposite ends of the perimeter opening. In some embodiments, the edge engagement pieces are orthogonal to the at least one direction. In some embodiments, the edge engagement pieces are configured to engage opposite walls of a cooler and suspend a bottom of the base above a floor of the cooler.

In some embodiments, the first and second edge engagement pieces include rubber pads, wherein the rubber pads are configured to be in a stable position on the walls of the cooler or freezer via friction.

In some embodiments, the first and second edge engagement pieces are extended out from the rim.

In some embodiments, the first and second edge engagement pieces form a handle on the opposite ends of the perimeter opening and wherein the rubber pads form part of the handle.

In some embodiments, the apparatus includes a retention apparatus configured to lock the rim in place in the at least one direction.

In some embodiments, the base and rim include a first basket frame and a second basket frame, wherein the first basket frame is an inner frame and the second basket frame is an outer frame. In some embodiments, the first and second basket frames are configured to overlap with the outer frame around the inner frame, whereby the base and rim are adjustable in length.

In some embodiments, the basket apparatus is adjustable in length and the basket apparatus includes a fully extended configuration and a fully contracted configuration. The fully extended configuration is longer than the fully contracted configuration.

In some embodiments, the rim further includes a rim track including a recessed track running along a portion of the rim.

In some embodiments, the retention apparatus is configured to engage the first basket frame with the second basket frame and lock the length of the basket apparatus.

In some embodiments, the base includes a solid base without any holes. In such embodiments, there may be a gap between the two parts of the base.

Referring now to FIG. 1, a perspective view of an adjustable cooler basket apparatus in a fully extended configuration is shown, according to one or more embodiments of this disclosure. Although the cooler basket apparatus 100 is shown and described with certain components and functionality, other embodiments of the cooler basket apparatus 100 may include fewer or more components to implement less or more functionality. Some features described in conjunction with this Figure may be applied to embodiments described in the other Figures described herein.

The cooler basket apparatus 100 is adjustable. The cooler basket apparatus 100 is adjustable in length. In the illustrated embodiment, the cooler basket apparatus 100 may be adjusted such that the two main pieces overlap with each other. The cooler basket apparatus 100 includes an inner basket frame 110 and an outer basket frame 160. These may be referred to as a first basket frame and a second basket frame. The two basket frames are configured to overlap with each other such that they form a single basket. The two basket frames are sized differently such that one basket is slightly smaller than the other so that there is an outer basket frame and an inner basket frame.

Figure 2:
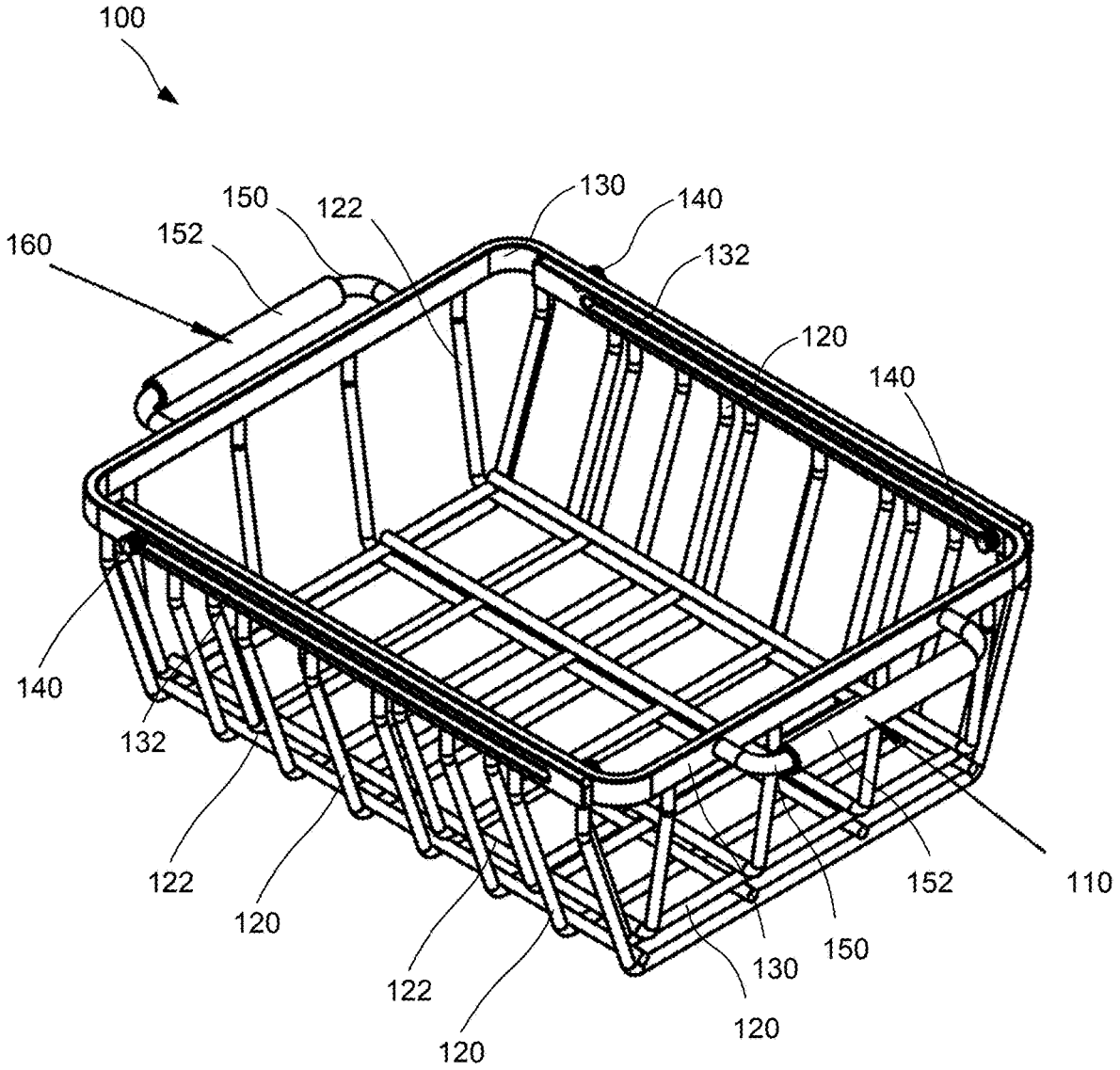
FIG. 2 depicts a perspective view of a cooler basket apparatus in a fully contracted configuration, according to one or more embodiments of this disclosure.

As can be seen in the illustrated embodiment, the inner basket frame 110 includes a rim or basket rim frame 130 that forms the rim of the basket (or more particularly half of the rim of the basket). The basket rim frame 130 of the inner basket frame 110 is a general U-shape with sides. Other shapes are contemplated herein. The basket rim frame 130 of the outer basket frame 160 is the same general shape but larger such that the sides of the two rim frames 130 can align and allow the basket to extend and retract as needed. This can be seen by comparing FIG. 1 and FIG. 2. The cooler basket apparatus 100 of FIG. 1 shows the cooler basket apparatus in a fully extended configuration. The cooler basket apparatus 100 of FIG. 2 shows the cooler basket apparatus in a fully contracted configuration. For the illustrated embodiment, there is an infinite number of lengths at which the cooler basket apparatus can be set between the fully extended configuration and the fully contracted configuration.

The inner basket frame 110 and the outer basket frame 160 are secured together and are locked in place with a retention device 140. In the illustrated embodiment, the retention device 140 is a tightening screw that can be tightened and loosened as needed. In the tightened position the retention device 140 will lock the length of the cooler basket apparatus 100. This makes the cooler basket apparatus 100 stable in length. This allows for the basket apparatus to be placed in whatever sized cooler or freezer and be stably placed and hold product. Although the retention device 140 is described as a tightening screw other types of retention devices 140 are contemplated herein such as clamps, clips, buttons, and the like. The function of the retention device 140 is to restrict movement between the two frames (or allow it when loosened). Other examples of a retention device 140 include springs that create tension to lock in place or tension rods that can be rotated into a locked position.

The cooler basket apparatus 100 includes generally a rim and a base. The base is a supporting infrastructure that is designed to hold and retain items within the basket apparatus. The rim is coupled to the base and forms a perimeter opening for the basket apparatus. In the illustrated embodiments, the base is formed by a plurality of tines 120, 122. There is a plurality of lateral tines 120 that run from side to side of the basket rim frame 130. There is also a plurality of longitudinal tines 122 that run from the end of the basket rim frame 130 and terminate near the last lateral tine 120. The tines are bent such that they run generally vertical from the basket rim frame to form the side walls of the basket and then run horizontal or generally parallel to the rim to form the bottom of the basket as can be seen. See FIG. 2 to see how the tines of the two basket frames can overlap each other similar to how the rim frames overlap. Although shown as tines that form a latticework, other embodiments may include solid bases (not tines) to form a solid base (no gaps or holes). There would still be a gap between the inner basket frame and the outer basket frame. Some embodiments may include a seal between the two frames at that gap, however.

The illustrated cooler basket apparatus 100 also includes handle frames 150 on each end of the cooler basket apparatus 100. And on each handle frame is a handle 152. In the illustrated embodiment, this is a rubber encasement that can produce friction between the basket apparatus and the wall of a cooler or freezer. This may be referred to as an edge engagement piece because the handle is configured to be the outermost part of the basket apparatus and is configured to engage with the walls of the cooler. The two edge engagement pieces are on opposite sides of the basket apparatus. Additionally, the two edge engagement pieces include a long surface that is generally orthogonal to the direction of expansion and contraction of the basket. In other words, the distance between the edge engagement pieces can be increased and decreased such that they will fit between and engage two opposite walls of a cooler (see FIG. 7 for a visual of this). In many embodiments, the edge engagement pieces include a friction inducing surface to ensure that the basket does not jostle around once it is placed within a cooler.

Because the walls of coolers are generally tapered, the length of the basket will also dictate how deep within the cavity of the cooler that the basket will sit. This can be seen by examining FIGS. 7 and 9 as a shorter basket can seat lower within the cooler. The adjustable length allows for the use of the basket apparatus within different size coolers but also allows the basket apparatus to be used at different depths within those coolers. This flexibility is a feature not found in the current technology.

In another embodiment the handle frames 150 are extendable and contractable in length. That is, the base and the rim of the basket may be fixed in length and the length of the basket apparatus is adjustable by adjusting the length of the handle frames 150 in a manner similar to what has been described in conjunction with the base and the rim in other embodiments. The handle frames 150 may be telescoping or otherwise collapsible. The lengthening of the handles would still occur orthogonally in direction from the handle 152 orientation. Additionally, the retention device 140 in such embodiments would be located on the handle frame 150 such that handle frames 150 length can be set. In some embodiments, only one handle frame 150 is adjustable in length. In other embodiments, both handle frames 150 are adjustable in length.

Referring now to FIG. 2, a perspective view of a cooler basket apparatus in a fully contracted configuration is shown, according to one or more embodiments of this disclosure. Although the cooler basket apparatus 100 is shown and described with certain components and functionality, other embodiments of the cooler basket apparatus 100 may include fewer or more components to implement less or more functionality. Some features described in conjunction with this Figure may be applied to embodiments described in the other Figures described herein.

As previously discussed, the cooler basket apparatus is in a fully contracted configuration. As can be seen, the sides of each rim frame 130 (for the inner basket frame 110 and the outer basket frame 160) overlap each other. The retention device 140 has been tightened and locked in place. As can further be seen, the tines of each basket frame are overlapping with each other such that the size of the base and rim are smaller. Most importantly, the distance between the two edge engagement pieces (or handles 152) is decreased so that the basket apparatus 100 can fit in smaller coolers or sit at a lower depth with a cooler. Some features described in conjunction with FIG. 1 may be applied to this Figure and such features are only not repeated for the sake of brevity.

Figure 3:
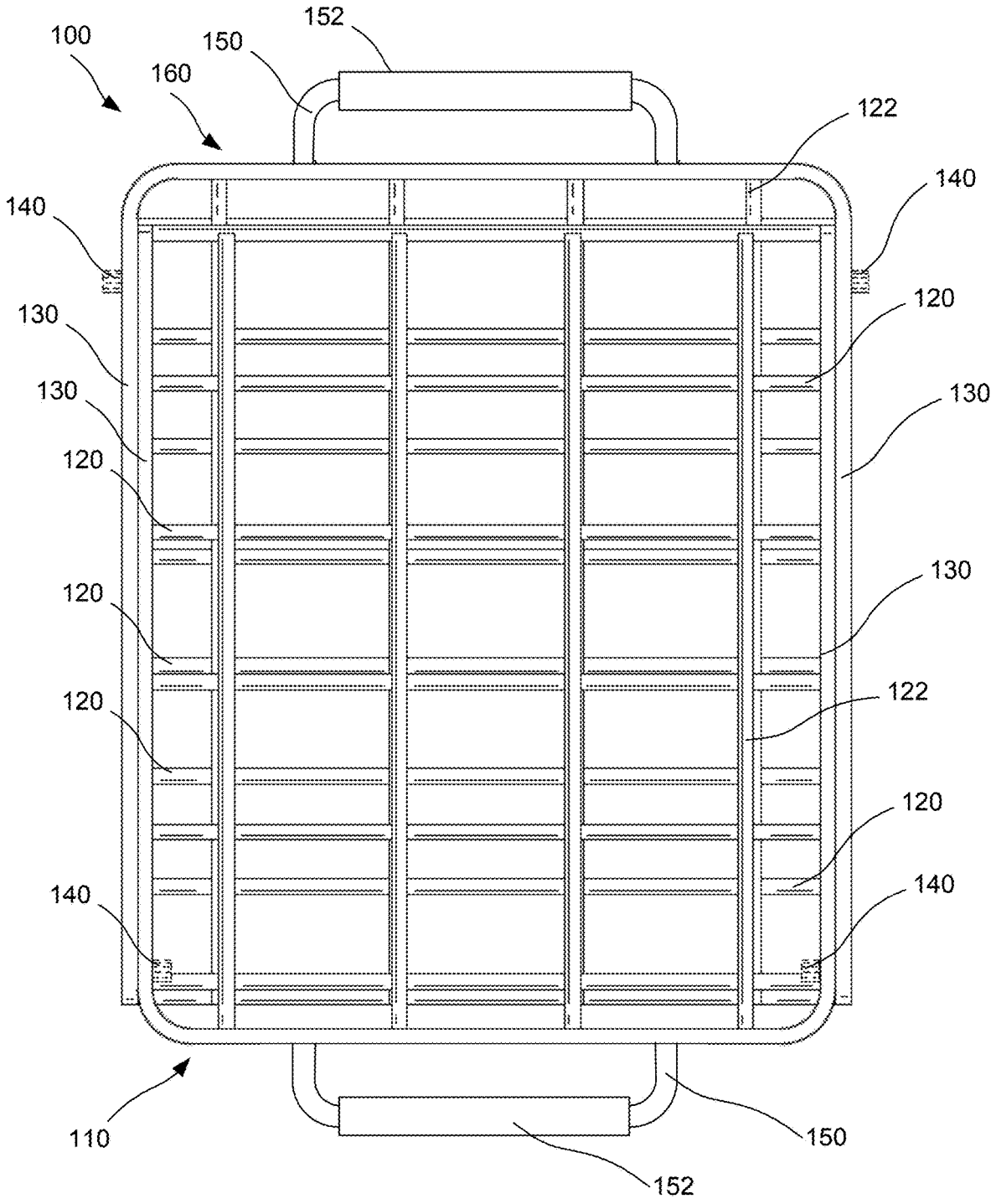
FIG. 3 depicts a top view of a cooler basket apparatus in a fully contracted configuration, according to one or more embodiments of this disclosure.

Referring now to FIG. 3, a top view of a cooler basket apparatus in a fully contracted configuration is shown, according to one or more embodiments of this disclosure. Although the cooler basket apparatus 100 is shown and described with certain components and functionality, other embodiments of the cooler basket apparatus 100 may include fewer or more components to implement less or more functionality. Some features described in conjunction with this Figure may be applied to embodiments described in the other Figures described herein.

In the illustrated embodiment, the basket apparatus is shown from above and depicts the shapes of the various features previously described as well as the physical relationship between those features. Some features described in conjunction with FIGS. 1 and 2 may be applied to this Figure and such features are only not repeated for the sake of brevity.

Figure 4:
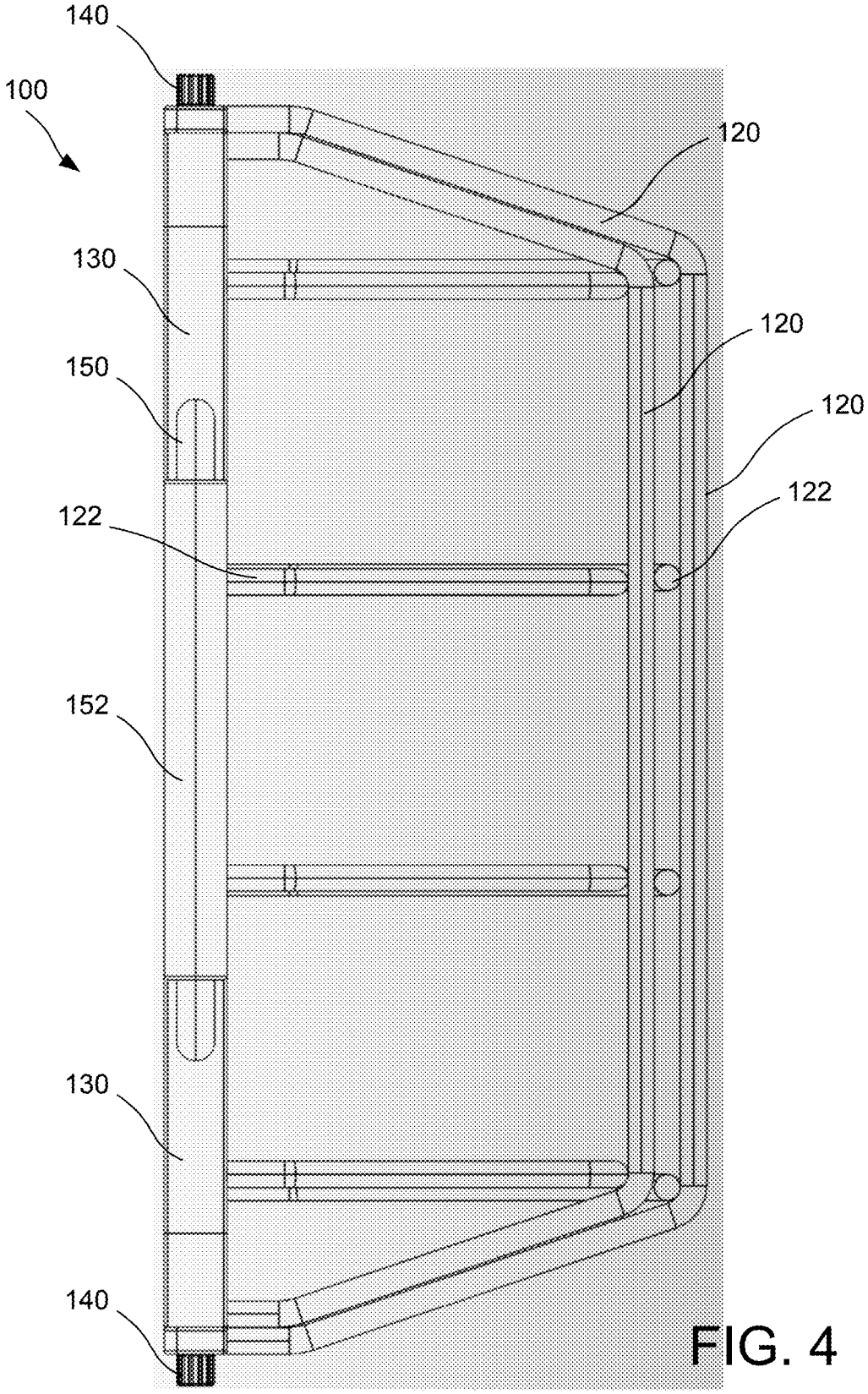
FIG. 4 depicts a front view of a cooler basket apparatus, according to one or more embodiments of this disclosure.

Referring now to FIG. 4, a front view of a cooler basket apparatus is shown, according to one or more embodiments of this disclosure. Although the cooler basket apparatus 100 is shown and described with certain components and functionality, other embodiments of the cooler basket apparatus 100 may include fewer or more components to implement less or more functionality. Some features described in conjunction with this Figure may be applied to embodiments described in the other Figures described herein.

FIG. 4 shows the relationship between the lateral tines and the longitudinal tines. As can be seen, the lateral tines sit on top of the longitudinal tines. Additionally, this view shows how the bases overlap generally with one of the frames functioning as an inner basket frame and the other as an outer basket frame. This embodiment shows the cooler basket apparatus in a fully contracted configuration. Some features described in conjunction with FIGS. 1-3 may be applied to this Figure and such features are only not repeated for the sake of brevity.

Figure 5:
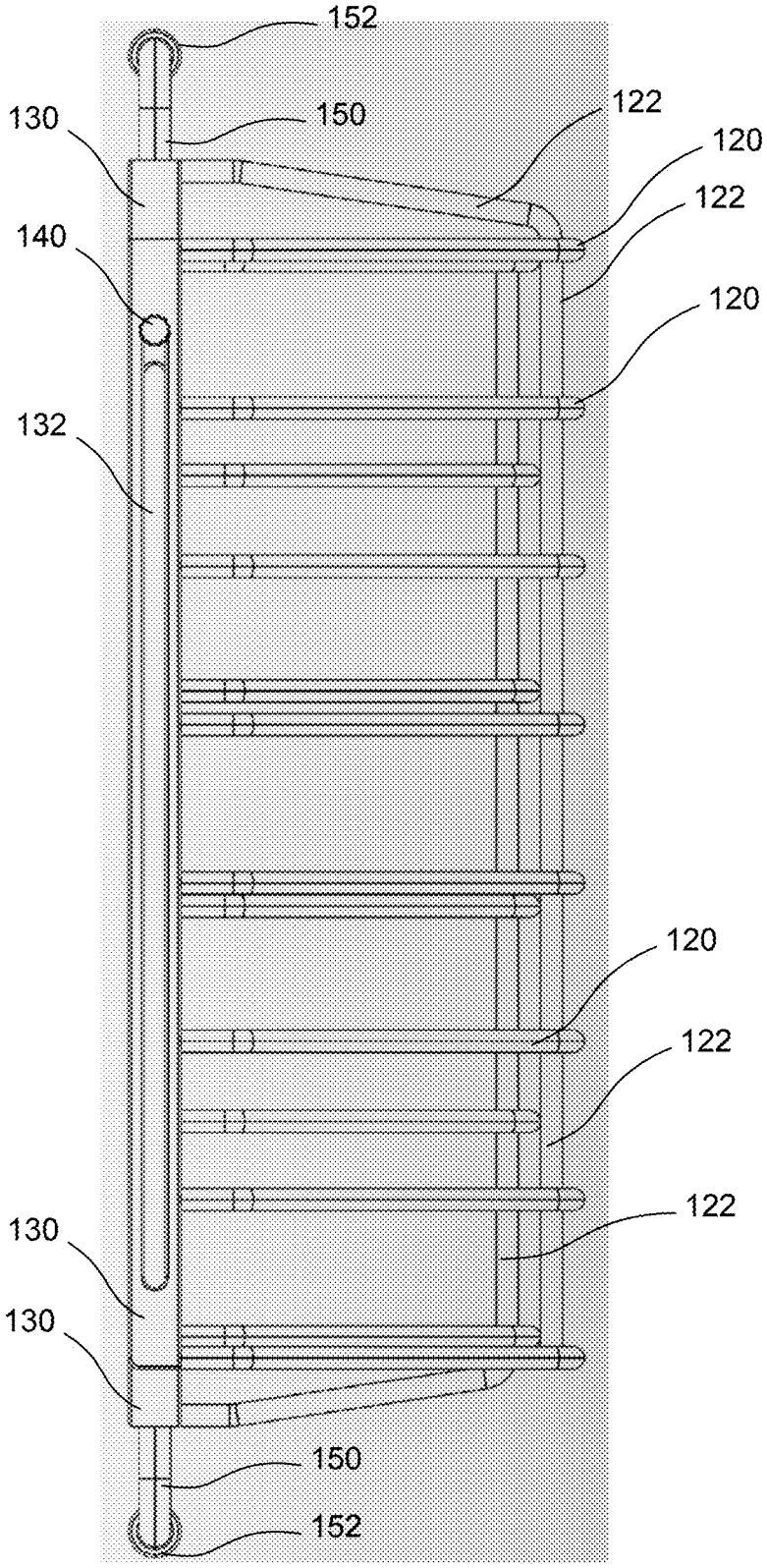
FIG. 5 depicts a side view of a cooler basket apparatus in a fully contracted configuration, according to one or more embodiments of this disclosure.

Referring now to FIG. 5, a side view of a cooler basket apparatus in a fully contracted configuration is shown, according to one or more embodiments of this disclosure. Although the cooler basket apparatus 100 is shown and described with certain components and functionality, other embodiments of the cooler basket apparatus 100 may include fewer or more components to implement less or more functionality. Some features described in conjunction with this Figure may be applied to embodiments described in the other Figures described herein.

FIG. 5 also shows the relationship between the lateral tines and the longitudinal tines. Additionally, this view shows how the bases overlap generally with one of the frames functioning as an inner basket frame and the other as an outer basket frame. This embodiment shows the cooler basket apparatus in a fully contracted configuration. Some features described in conjunction with FIGS. 1-4 may be applied to this Figure and such features are only not repeated for the sake of brevity.

Figure 6:
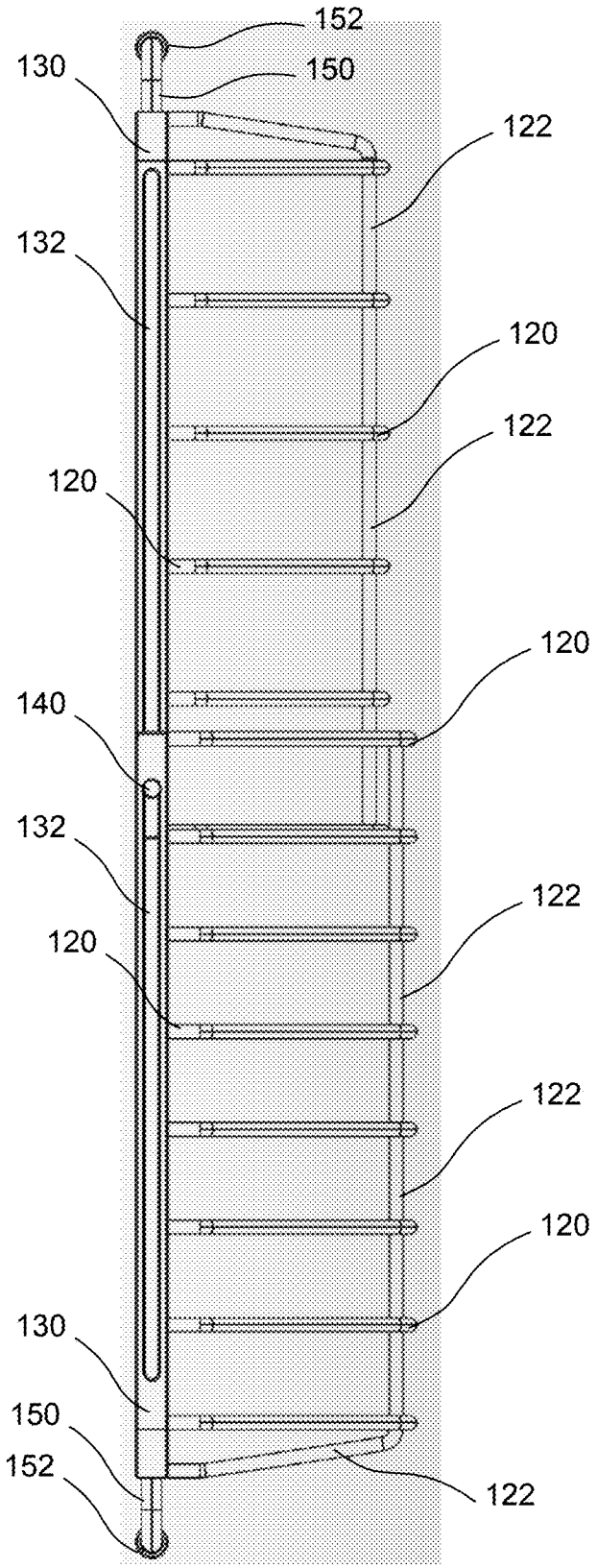
FIG. 6 depicts a side view of a cooler basket apparatus in a fully extended configuration, according to one or more embodiments of this disclosure.

Referring now to FIG. 6, a side view of a cooler basket apparatus in a fully extended configuration is shown, according to one or more embodiments of this disclosure. Although the cooler basket apparatus 100 is shown and described with certain components and functionality, other embodiments of the cooler basket apparatus 100 may include fewer or more components to implement less or more functionality. Some features described in conjunction with this Figure may be applied to embodiments described in the other Figures described herein.

As can be seen, the two basket frames only overlap a little (where the retention device 140 engages the two frames). This view helps show how the inner basket frame 110 can slide together with the outer basket frame 160. FIGS. 5 and 6 show the basket apparatus at the two extremes (the fully extended configuration of FIG. 6 and the fully contracted configuration of FIG. 5). Some features described in conjunction with FIGS. 1-5 may be applied to this Figure and such features are only not repeated for the sake of brevity.

Figure 7:
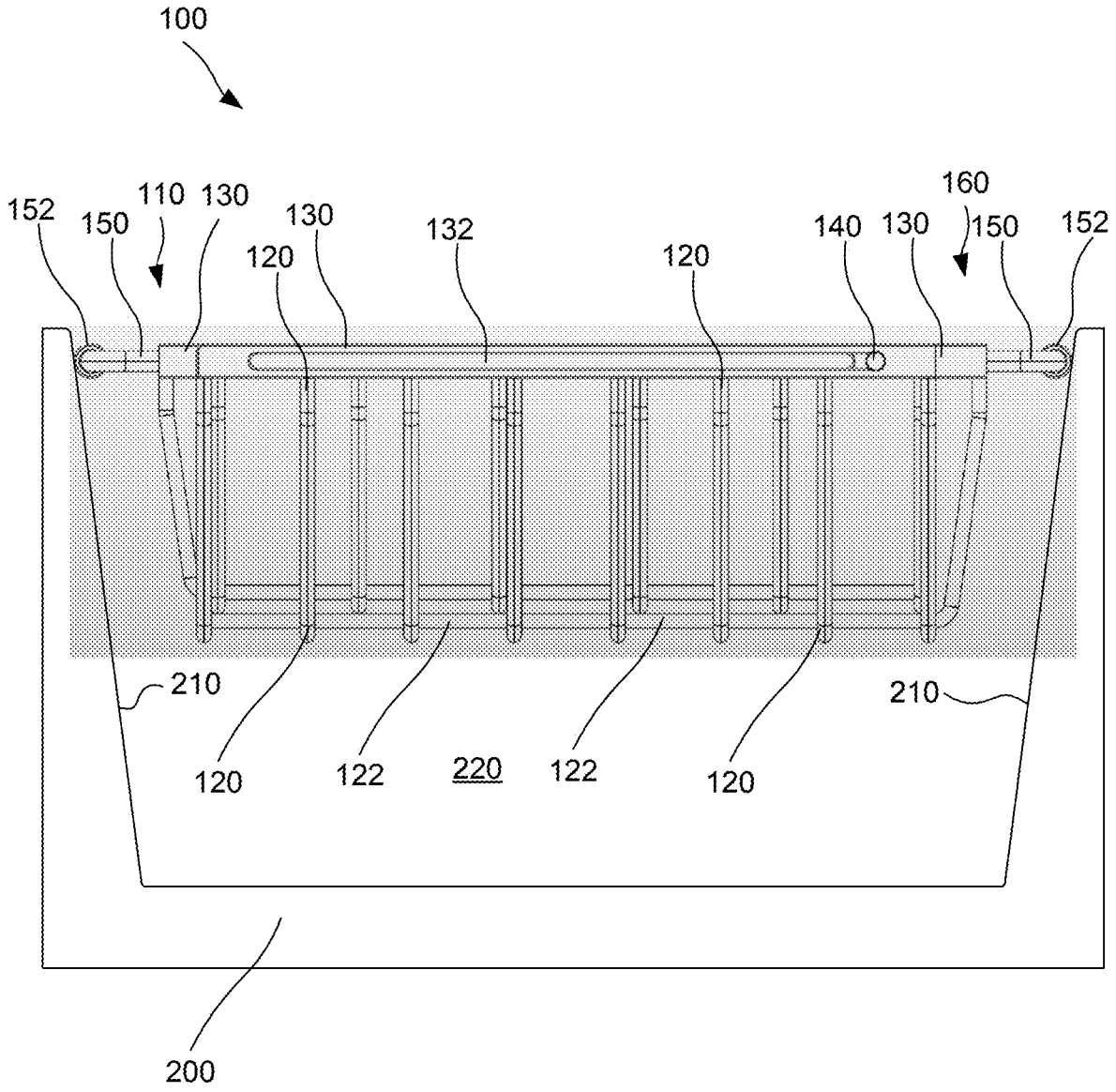
FIG. 7 depicts a side view of a cooler basket apparatus in a fully contracted configuration resting in a cooler, according to one or more embodiments of this disclosure.

Referring now to FIG. 7, a side view of a cooler basket apparatus in a fully contracted configuration resting in a cooler is shown, according to one or more embodiments of this disclosure. Although the cooler basket apparatus 100 is shown and described with certain components and functionality, other embodiments of the cooler basket apparatus 100 may include fewer or more components to implement less or more functionality. Some features described in conjunction with this Figure may be applied to embodiments described in the other Figures described herein.

FIG. 7 shows the basket apparatus 100 in use in a cooler (shown in a cutaway view so that we can see in the cavity of the cooler). For simplicity the cooler's base is shown without a lid which would typically be present to cap the cavity. The cooler basket apparatus 100 is shown seated in the cooler 200 such that the edge engagement pieces or handles 150 are engaged with the sidewalls 210 of the cooler 200. Generally, coolers have tapered walls as shown (the taper is shown in exaggerated form for effect). The basket is configured to sit in the cavity 220 and raised above the floor of the cooler. As the cooler basket apparatus 100 is adjustable in length, the length selected will determine how deep within the cavity that the cooler basket apparatus will sit (compare FIGS. 7 and 9). Additionally, because coolers are not all the same size, the adjustable length allows for the cooler basket apparatus to be used in various size coolers. Some features described in conjunction with FIGS. 1-6 may be applied to this Figure and such features are only not repeated for the sake of brevity.

Figure 8:
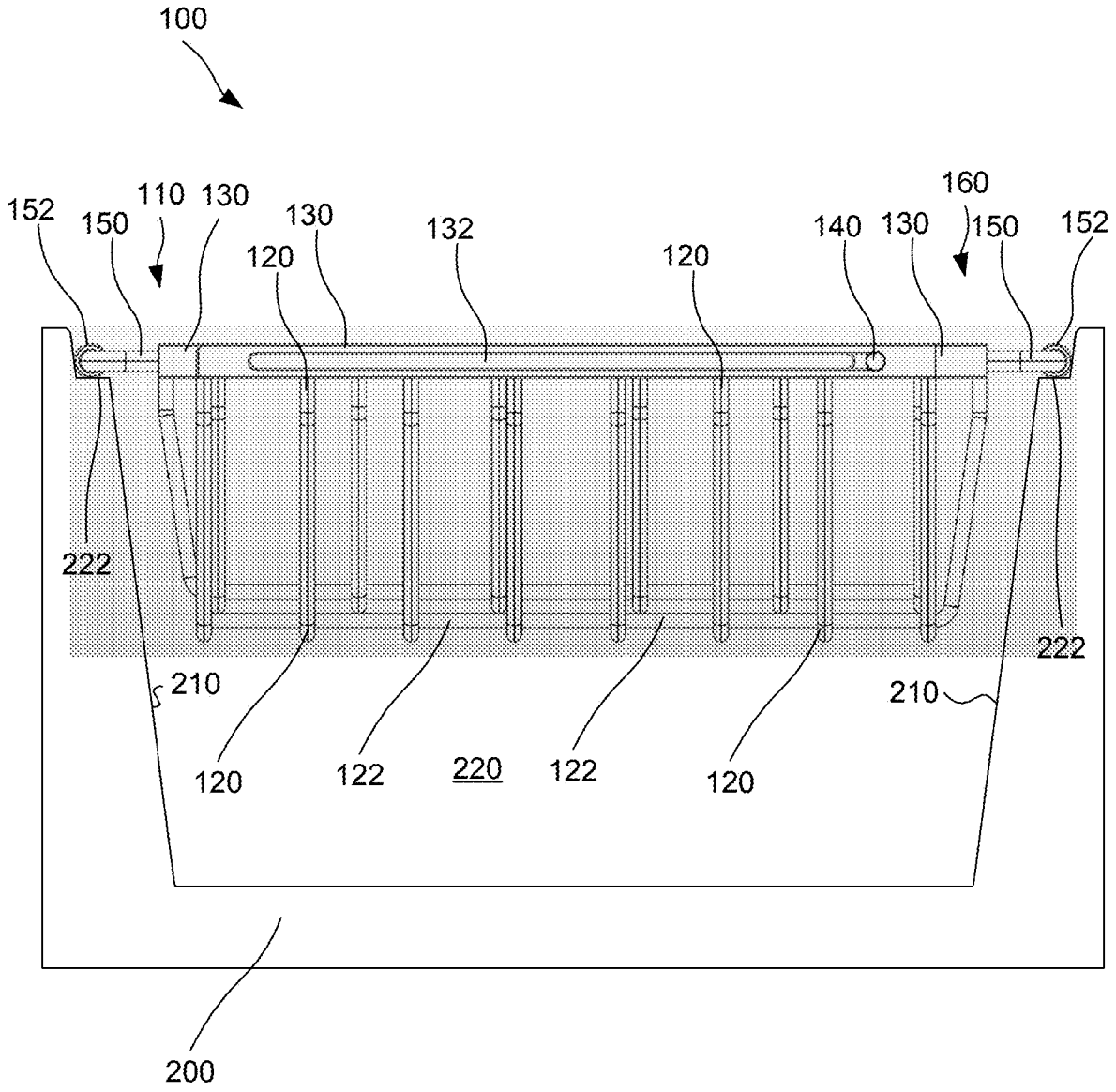
FIG. 8 depicts a side view of a cooler basket apparatus in a fully contracted configuration resting in a cooler with the edge engagement pieces resting on a ledge of the cooler, according to one or more embodiments of this disclosure.

Referring now to FIG. 8, a side view of a cooler basket apparatus in a fully contracted configuration resting in a cooler with the edge engagement pieces resting on a ledge of the cooler is shown, according to one or more embodiments of this disclosure. Although the cooler basket apparatus 100 is shown and described with certain components and functionality, other embodiments of the cooler basket apparatus 100 may include fewer or more components to implement less or more functionality. Some features described in conjunction with this Figure may be applied to embodiments described in the other Figures described herein.

FIG. 8 is shown to depict the cooler basket apparatus engaging a ledge 222 within the cooler. Some coolers may have ledges. In such cases, the edge engagement pieces or handles 152 can engage with the cooler and rest on the ledges. Some features described in conjunction with FIGS. 1-7 may be applied to this Figure and such features are only not repeated for the sake of brevity.

Figure 9:
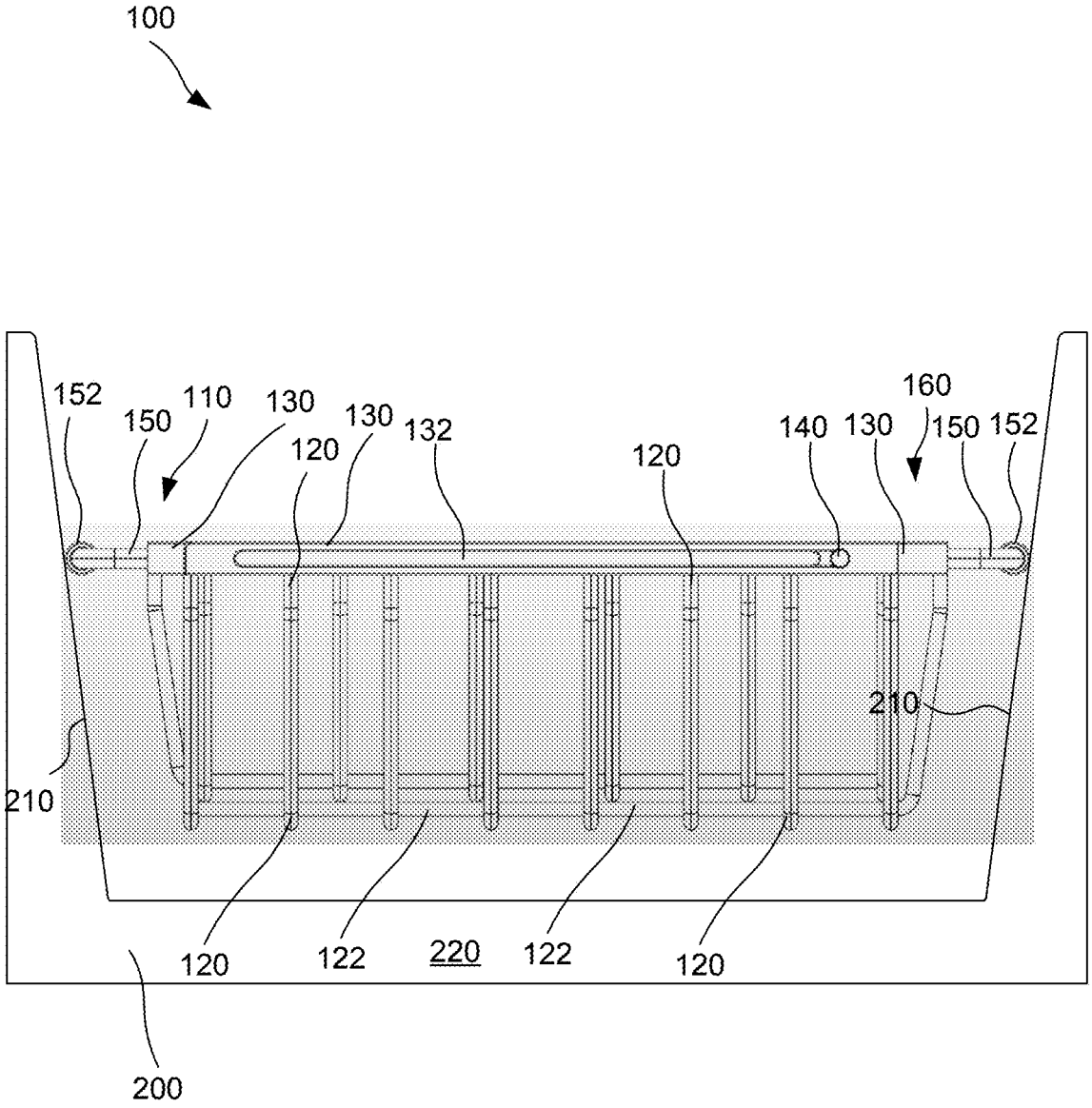
FIG. 9 depicts a side view of a cooler basket apparatus in a fully contracted configuration resting in a cooler at a lower height, according to one or more embodiments of this disclosure.

Referring now to FIG. 9, a side view of a cooler basket apparatus in a fully contracted configuration resting in a cooler at a lower height is shown, according to one or more embodiments of this disclosure. Although the cooler basket apparatus 100 is shown and described with certain components and functionality, other embodiments of the cooler basket apparatus 100 may include fewer or more components to implement less or more functionality. Some features described in conjunction with this Figure may be applied to embodiments described in the other Figures described herein.

As can be seen, the cooler basket apparatus 100 may be seated lower within the cavity 220 of the cooler 200 and sit lower on the walls 210 of the cooler if the distance between the handles 152 is shorter. Lengthening the distance between the handles 152 will make the cooler basket apparatus sit higher up the walls 210 and create more distance between the bottom of the base and the floor of the cooler. Some features described in conjunction with FIGS. 1-8 may be applied to this Figure and such features are only not repeated for the sake of brevity.

Although described generally herein with respect to a cooler, the basket apparatus may be used in a chest freezer or refrigerator as well. The functions of the adjustable length of the basket apparatus may allow for the apparatus to be used in various size freezers or refrigerators as well.

In the above description, specific details of various embodiments are provided. However, some embodiments may be practiced with less than all of these specific details. In other instances, certain methods, procedures, components, structures, and/or functions are described in no more detail than to enable the various embodiments of the invention, for the sake of brevity and clarity.

Although specific embodiments of the invention have been described and illustrated, the invention is not to be limited to the specific forms or arrangements of parts so described and illustrated. The scope of the invention is to be defined by the claims appended hereto and their equivalents.

Throughout this specification and the claims which follow, unless the context requires otherwise, the word "comprise", and variations such as "comprises" and "comprising", will be understood to imply the inclusion of a stated integer or step or group of integers or steps but not the exclusion of any other integer or step or group of integers or steps.

Reference throughout this specification to features, advantages, or similar language does not imply that all of the features and advantages that may be realized with the subject matter of the present disclosure should be or are in any single embodiment. Rather, language referring to the features and advantages is understood to mean that a specific feature, advantage, or characteristic described in connection with an embodiment is included in at least one embodiment of the present disclosure. Thus, discussion of the features and advantages, and similar language, throughout this specification may, but do not necessarily, refer to the same embodiment.

In the above description, certain terms may be used such as "up," "down," "upper," "lower," "horizontal," "vertical," "left," "right," and the like. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object. Further, the terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise.

As used herein, the phrase "at least one of", when used with a list of items, means different combinations of one or more of the listed items may be used and only one of the items in the list may be needed. The item may be a particular object, thing, or category. In other words, "at least one of" means any combination of items or number of items may be used from the list, but not all of the items in the list may be required. For example, "at least one of item A, item B, and item C" may mean item A; item A and item B; item B; item A, item B, and item C; or item B and item C. In some cases, "at least one of item A, item B, and item C" may mean, for example, without limitation, two of item A, one of item B, and ten of item C; four of item B and seven of item C; or some other suitable combination.

As used herein, a system, apparatus, structure, article, element, component, or hardware "configured to" perform a specified function is indeed capable of performing the specified function without any alteration, rather than merely having potential to perform the specified function after further modification. In other words, the system, apparatus, structure, article, element, component, or hardware "configured to" perform a specified function is specifically selected, created, implemented, utilized, programmed, and/or designed for the purpose of performing the specified function. As used herein, "configured to" denotes existing characteristics of a system, apparatus, structure, article, element, component, or hardware which enable the system, apparatus, structure, article, element, component, or hardware to perform the specified function without further modification. For purposes of this disclosure, a system, apparatus, structure, article, element, component, or hardware described as being "configured to" perform a particular function may additionally or alternatively be described as being "adapted to" and/or as being "operative to" perform that function.

What is claimed is:

1. A basket apparatus, the basket apparatus comprising:
- a cooler;
- a base comprising of a supporting infrastructure holding and retaining items within the basket apparatus;
- a rim coupled to the base, wherein the rim forms a perimeter opening to the base of the basket apparatus, and wherein the base is adjustable in length in at least one direction and wherein the rim is adjustable in length in the at least one direction;
- a retention apparatus configured to lock the rim in place in the at least one direction; and
- a first edge engagement piece and a second edge engagement piece located on opposite ends of the perimeter opening, wherein the first and second edge engagement pieces are orthogonal to the at least one direction, and
- wherein the first and second edge engagement pieces engage opposite walls of the cooler and suspend a bottom of the base above a floor of the cooler.

2. The basket apparatus of claim 1, wherein the first and second edge engagement pieces comprise rubber pads, wherein the rubber pads are contacting the walls of the cooler and are stabilized via friction.

3. The basket apparatus of claim 2, wherein the first and second edge engagement pieces form a handle on the opposite ends of the perimeter opening and wherein the rubber pads form part of the handle.

4. The basket apparatus of claim 1, wherein the first and second edge engagement pieces are extended out from the rim.

5. The basket apparatus of claim 1, wherein the base and rim comprises a first basket frame and a second basket frame, wherein the first basket frame is an inner frame and the second basket frame is an outer frame, wherein the first and second basket frames are configured to overlap with the outer frame around the inner frame, whereby the base and rim are adjustable in length.

6. The basket apparatus of claim 5, wherein the basket apparatus is adjustable in length and the basket apparatus comprises a fully extended configuration and a fully contracted configuration.

7. The basket apparatus of claim 6, wherein the fully extended configuration is longer than the fully contracted configuration.

8. The basket apparatus of claim 7, wherein the rim further comprises a rim track comprising a recessed track running along a portion of the rim.

9. The basket apparatus of claim 8, wherein the retention apparatus is configured to engage the first basket frame with the second basket frame and lock the length of the basket apparatus.

10. The basket apparatus of claim 1, wherein the base comprises a plurality of tines forming a lattice.

11. An adjustable cooler basket apparatus, the cooler basket apparatus comprising:

a cooler;

a base comprising of a supporting infrastructure holding and retaining items within the cooler basket apparatus;

a rim coupled to the base, wherein the rim forms a perimeter opening to the base of the cooler basket apparatus, and wherein the base is adjustable in length in at least one direction and wherein the rim is adjustable in length in the at least one direction;

a first edge engagement piece and a second edge engagement piece located on opposite ends of the perimeter opening, wherein the first and second edge engagement pieces are orthogonal to the at least one direction, and wherein the first and second edge engagement pieces contact opposite walls of the cooler and suspend a bottom of the base above a floor of the cooler, wherein the first and second edge engagement pieces are stabilized against the opposite walls via friction.

12. The cooler basket apparatus of claim 11, wherein the first and second edge engagement pieces comprise rubber pads, wherein the rubber pads are contacting the walls of the cooler.

13. The cooler basket apparatus of claim 12, wherein the first and second edge engagement pieces are extended out from the rim.

14. The cooler basket apparatus of claim 12, wherein the first and second edge engagement pieces form a handle on the opposite ends of the perimeter opening and wherein the rubber pads form part of the handle.

15. The cooler basket apparatus of claim 11, further comprising a retention apparatus configured to lock the rim in place in the at least one direction.

16. The cooler basket apparatus of claim 15, wherein the base and rim comprises a first basket frame and a second basket frame, wherein the first basket frame is an inner frame and the second basket frame is an outer frame, wherein the first and second basket frames are configured to overlap with the outer frame around the inner frame, whereby the base and rim are adjustable in length.

17. The cooler basket apparatus of claim 16, wherein the basket apparatus is adjustable in length and the basket apparatus comprises a fully extended configuration and a fully contracted configuration.

18. The cooler basket apparatus of claim 17, wherein the fully extended configuration is longer than the fully contracted configuration.

19. The cooler basket apparatus of claim 18, wherein the rim further comprises a rim track comprising a recessed track running along a portion of the rim.

20. The cooler basket apparatus of claim 19, wherein the retention apparatus is configured to engage the first basket frame with the second basket frame and lock the length of the basket apparatus.

* * * * *